US007554058B2

(12) United States Patent
Stahl et al.

(10) Patent No.: US 7,554,058 B2
(45) Date of Patent: Jun. 30, 2009

(54) DOMESTIC APPLIANCE, ESPECIALLY COOKING APPLIANCE

(75) Inventors: Matthias Stahl, Oerlinghausen (DE); Hermann Bronstering, Wadersloh (DE); Claudia Scholt, Bielefeld (DE)

(73) Assignee: Miele & Cie. KG, Guetersloh (DE)

( * ) Notice: Subject to any disclaimer, the term of this patent is extended or adjusted under 35 U.S.C. 154(b) by 266 days.

(21) Appl. No.: 10/599,516

(22) PCT Filed: Mar. 1, 2005

(86) PCT No.: PCT/EP2005/002123

§ 371 (c)(1),
(2), (4) Date: Sep. 29, 2006

(87) PCT Pub. No.: WO2005/106334

PCT Pub. Date: Nov. 10, 2005

(65) Prior Publication Data

US 2007/0210057 A1 Sep. 13, 2007

(30) Foreign Application Priority Data

Mar. 31, 2004 (DE) ..... 10 2004 015 751

(51) Int. Cl.

| | |
|---|---|
| ***F24B 7/02*** | (2006.01) |
| ***F24C 15/02*** | (2006.01) |
| ***F24C 15/04*** | (2006.01) |
| ***F24C 15/32*** | (2006.01) |
| ***F24C 7/08*** | (2006.01) |
| ***A21B 3/02*** | (2006.01) |

(52) U.S. Cl. ..... 219/391; 219/414; 219/506; 126/190

(58) Field of Classification Search ..... None
See application file for complete search history.

(56) References Cited

U.S. PATENT DOCUMENTS 5,126,724 A 6/1992 Feuerlein et al.

(Continued)

FOREIGN PATENT DOCUMENTS

DE 2167022 7/1977

(Continued)

OTHER PUBLICATIONS

International preliminary report on patentability for International No. PCT/EP2005/002123 mailed on Nov. 1, 2006.

(Continued)

*Primary Examiner*—Joseph M Pelham
(74) *Attorney, Agent, or Firm*—Darby & Darby

(57) ABSTRACT

A household appliance includes a body having a front, an appliance port including a cooling air inlet port and/or a vapor exhaust port disposed on the body, and a door. A console-type user control and display unit is provided including a control and display element, a housing, and control electronics disposed in the housing. The control electronics provide signal communication with the control and display element and with power electronics of the household appliance. At least a first portion of the user control and display unit is disposed on the door so as to be cooled by a flow of ambient air and so as to shield, when the door is in a closed position, the appliance port from view in a direction perpendicular to the front of the body.

11 Claims, 5 Drawing Sheets

U.S. PATENT DOCUMENTS

| | | | | |
|---|---|---|---|---|
| 5,589,958 | A * | 12/1996 | Lieb | 349/16 |
| 7,082,777 | B2 * | 8/2006 | Becke et al. | 62/246 |
| 2003/0209018 | A1 * | 11/2003 | Becke et al. | 62/126 |

FOREIGN PATENT DOCUMENTS

| | | |
|---|---|---|
| DE | 3404256 | 8/1985 |
| DE | 3621260 | 1/1988 |
| DE | 3838401 | 5/1990 |
| DE | 4017629 | 12/1991 |
| DE | 9113763 | 12/1991 |
| DE | 4124921 | 1/1993 |
| DE | 9116898 | 6/1994 |
| DE | 10045236 | 3/2002 |
| EP | 0541053 | 5/1993 |
| EP | 0726425 | 8/1996 |
| JP | 60243430 | 12/1985 |
| JP | 02230026 | 9/1990 |

OTHER PUBLICATIONS

International Search Report for International No. PCT/EP2005/002123 mailed on May 13, 2005.

* cited by examiner

DOMESTIC APPLIANCE, ESPECIALLY COOKING APPLIANCE

CROSS REFERENCE TO PRIOR APPLICATION

This is a U.S. national phase application under 35 U.S.C. §371 of International Patent Application No. PCT/EP2005/002123, filed Mar. 1, 2005, and claims benefit of German Patent Application No. 10 2004 015 751.0, filed Mar. 31, 2004, which is incorporated by reference herein. The International Application was published in German on Nov. 10, 2005 as 2005/106334 A1 under PCT Article 21(2).

The present invention relates to a household appliance, in particular a cooking appliance, having a front which extends substantially perpendicular to an installation surface when the household appliance is in the normal operating position and which has a console-type user control and display unit provided on the outer surface thereof.

BACKGROUND

A household appliance having a front which extends substantially perpendicular to an installation surface when the household appliance is in the normal operating position is already known from DE 36 21 260 A1. A console-type user control and display unit is provided on the outer surface of the front, the interior of the housing of the user control and display unit accommodating control electronics which are in signal communication with the control and display elements of the user control and display unit and with power electronics located in the remainder of the household appliance.

A similar arrangement is found in the household appliance disclosed in DE 40 17 629 A1. Here, in contrast to the first-mentioned household appliance, the user control and display unit is not tiltable from a console-type operating position to a rest position substantially flush with the outer surface of the front.

In order to improve the cooling of the user control and display unit of a baking oven, German Patent DE 41 24 921 C2 proposes that ambient air be passed through the housing of the user control and display unit by means of a suction generated by vapors discharged from the baking oven and/or cooling air emerging therefrom.

Document DE 100 45 236 A1 describes a household appliance which has a body and a door and in which the front forms a unit with the door, a console-type display unit being integrated into the handle of the door. Here, in contrast to the aforementioned household appliances, the display unit has only display elements.

Furthermore, it is known from DE 91 13 763 U1 to integrate a user control and display unit into a handle of a household appliance.

SUMMARY

Therefore, it is an object of the present invention to provide a household appliance that provides improved protection of the control electronics of the user control and display unit from elevated temperatures.

The present invention provides a household appliance including: a body having a front; an appliance port including at least one of a cooling air inlet port and a vapor exhaust port disposed on the body; a door; and a console-type user control and display unit, the user control and display unit including a control and display element, a housing, and control electronics disposed in the housing. The control electronics is configured for signal communication with the control and display element and with power electronics of the household appliance, at least a first portion of the user control and display unit being disposed on the door so as to be cooled by a flow of ambient air and so as to shield, when the door is in a closed position, the appliance port from view in a direction perpendicular to the front of the body.

One particular advantage that can be achieved with the present invention is the improvement of the protection of the control electronics of the user control and display unit from elevated temperatures.

BRIEF DESCRIPTION OF THE DRAWINGS

Exemplary embodiments of the present invention are shown in the drawings in a schematic way and will be described in more detail below. In the drawings.

DETAILED DESCRIPTION

Figure 1:
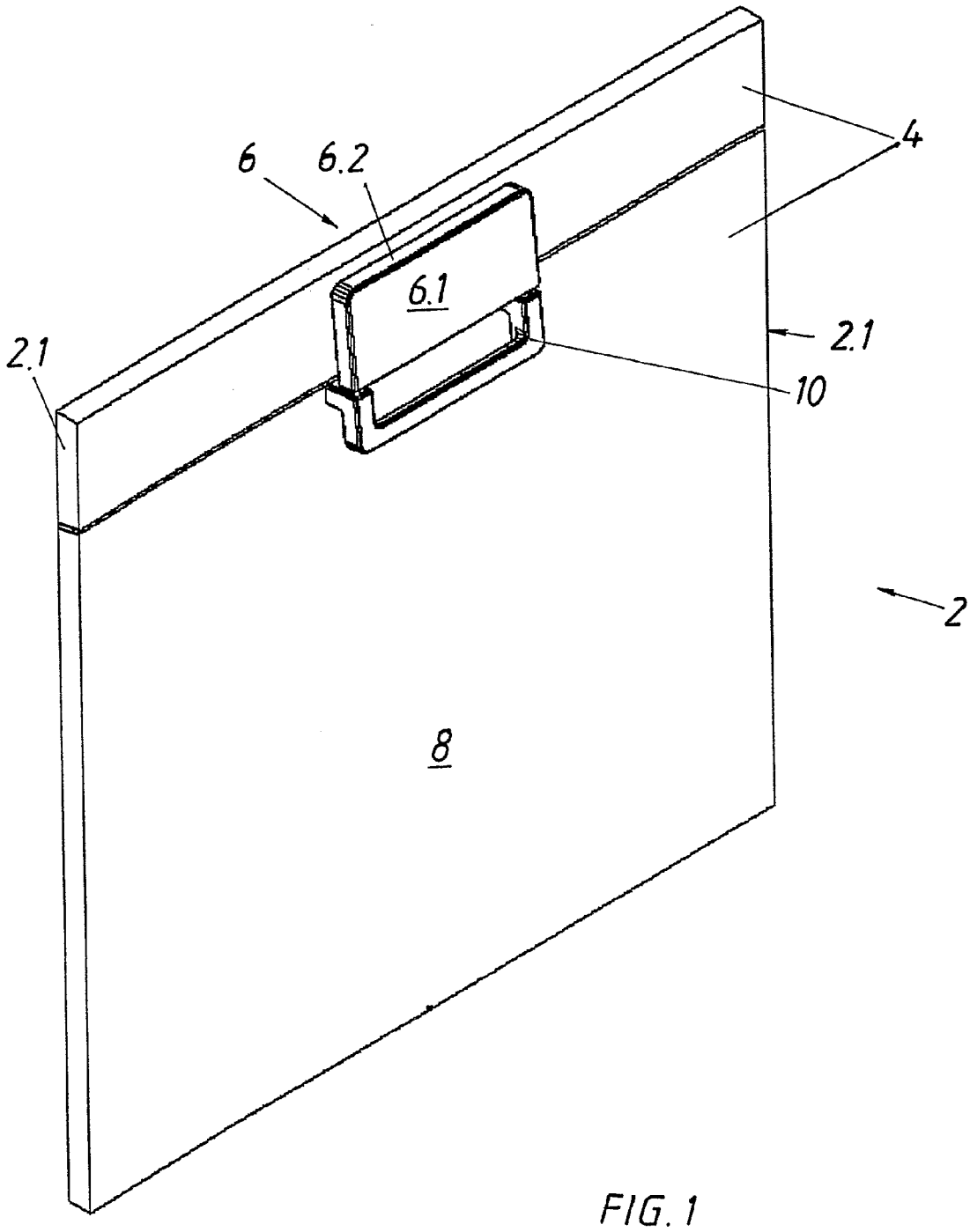
FIG. 1 is a partial perspective view of a first exemplary embodiment of a household appliance according to the present invention.

The spatial arrangement of the user control and display unit may, in principle, be selected within wide suitable limits. Conveniently, the user control and display unit is disposed on the outer surface of the front in such a manner that it is substantially equally spaced from the lateral edges thereof with respect to the normal operating position of the household appliance.

If the household appliance according to the present invention has a body and a door, and the front includes an upper part and a lower part, the upper part being attached to or forming a unit with the body and the lower part being attached to or forming a unit with the door, and the user control and display unit being disposed on the upper part of the front, then the position of a handle mounted on the door relative to the user control and display unit, as well as the structural design thereof, may be selected within wide suitable limits. Conveniently, the handle is designed such that it gives the visual impression of an extension of the console-type user control and display unit when the door is closed. This improves the overall visual appearance of the door.

If the household appliance according to the present invention has a body and a door, and the front includes an upper part and a lower part, the upper part being attached to or forming a unit with the body and the lower part being attached to or forming a unit with the door, then, according to an advantageous refinement, the door is provided with a handle, and the user control and display device forms a unit with the handle.

In another refinement of the teaching according to the present invention, the user control and display unit takes the form of a display unit having control elements. In this manner, the overall visual appearance of the user control and display unit is further improved.

In another advantageous refinement, when the door is closed, a cooling air inlet port or vapor exhaust port disposed on the body is covered by the display and user control unit in such a manner that the inlet or exhaust port cannot be visually perceived when looking in a direction perpendicular to the outer surface of the front. In this manner, the overall visual appearance is further improved.

In one advantageous refinement, when the door is closed, a cooling air inlet port or vapor exhaust port disposed on the body is covered by the display and user control unit in such a manner that the air entering the inlet port and the air emerging from the exhaust port, respectively, is diverted by the display and user control unit into a predetermined direction. In this manner, the number of components is reduced.

In another advantageous refinement, the user control and display unit is mounted on the front in a manner that substantially avoids heat transfer between the body and/or door and the user control and display unit. This further improves the thermal isolation of the user control and display unit, and thus of the control electronics, from the remainder of the household appliance, which heats up during the operation of the household appliance.

FIG. 1 shows a first exemplary embodiment of an inventive household appliance which takes the form of a cooking appliance and of which only the two-part front 2 is shown. When the household appliance of the present invention is in the normal operating position, front 2 of the household appliance extends substantially perpendicular to an installation surface of the household appliance. A console-type user control and display unit 6 is provided on outer surface 4 of front 2. In this exemplary embodiment, user control and display unit 6 takes the form of a so-called touch screen 6.1, i.e., a possible type of a display unit having control elements. The interior of housing 6.2 of user control and display unit 6 accommodates control electronics 5, which are in signal communication 7 with control and display elements 6.1 of user control and display unit 6 and with power electronics 9 located in the remainder of the household appliance.

Housing 6.2 of user control and display unit 6 is arranged on outer surface 4 of front 2 in such a manner that at least the area of housing 6.2 where the control electronics 5 are located is permanently traversed by a flow of ambient air. This becomes particularly apparent from FIG. 2.

In the present exemplary embodiment, the household appliance has a body 11 and a door 8, and front 2 includes an upper part and a lower part, the upper part being attached to the body and the lower part forming a unit with door 8. When door 8 is closed, the body and door 8 bound a cooking chamber. User control and display unit 6 is disposed on the upper part of front 2 on the outer surface 4 thereof. Door 8 has a handle 10 attached thereto. Handle 10 is designed such that it gives the visual impression of an extension of console-type user control and display unit 6 when door 3 is closed, as shown in FIG. 1.

When the household appliance of the present invention is in the normal operation position shown in FIG. 1, user control and display unit 6 and handle 10 are substantially equally spaced from the lateral edges 2.1 of front 2.

Figure 2:
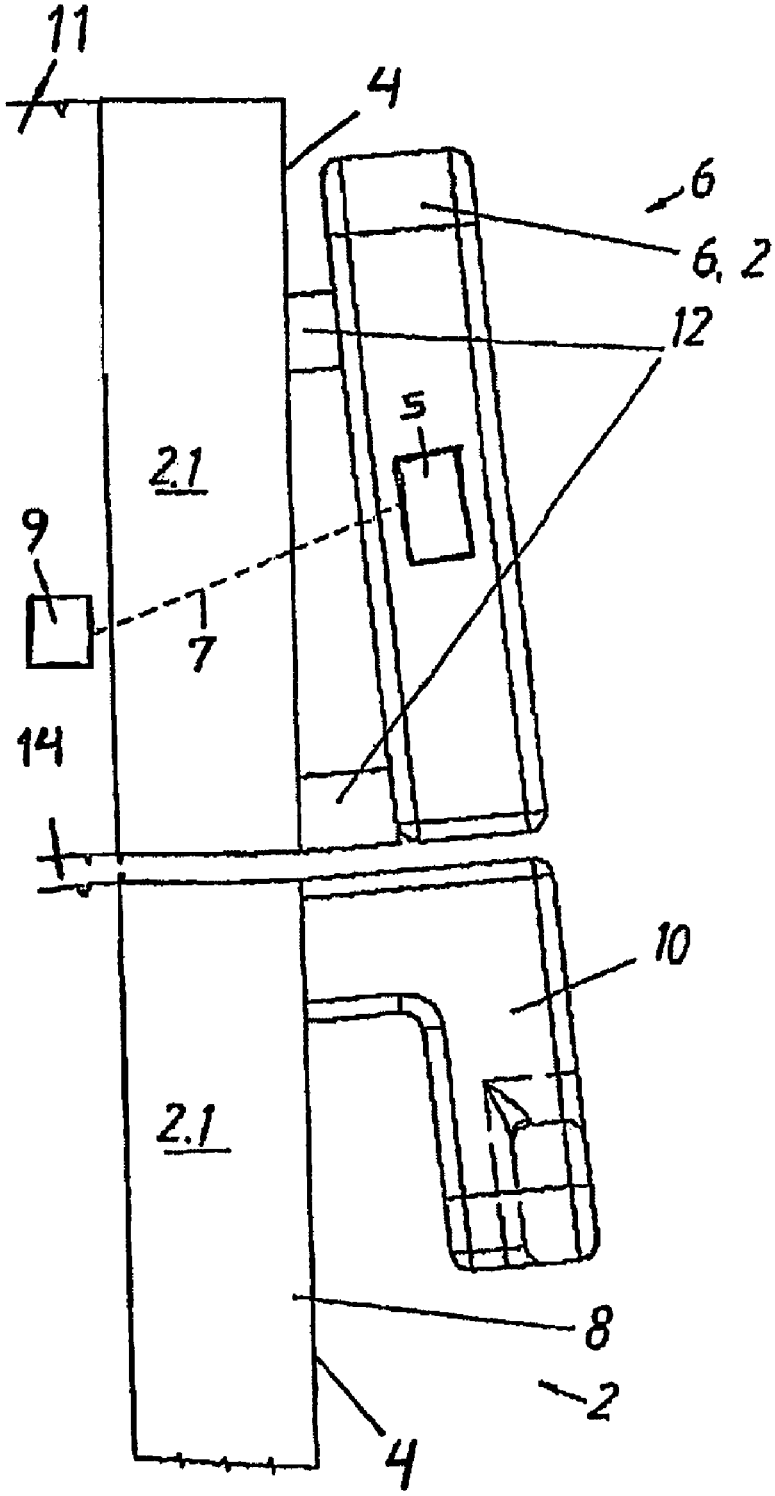
FIG. 2 is a partial side view of the first exemplary embodiment of FIG. 1.

FIG. 2 shows the first exemplary embodiment in a partial side view. As can be clearly seen from FIG. 2, housing 6.2 of user control and display unit 6 is arranged on outer surface 4 of front 2 in such a manner that at least the area of housing 6.2 where the control electronics 5 are located is permanently traversed by a flow of ambient air. To this end, in the present exemplary embodiment, user control and display unit 6 is mounted to the upper part of outer surface 4 of front 2 by means of mounting blocks 12 in a manner known to those skilled in the art. In this exemplary embodiment, the signal transmission link 7 between the control electronics located in housing 6.2 and power electronics located in the body 11 is provided by electrical wires running through one of mounting blocks 12. Alternatively, any other signal transmission link known to those skilled in the art could be used.

The household appliance of the present invention, therefore, provides improved protection of the control electronics of the user control and display unit from elevated temperatures.

In order to further improve this effect of the aforementioned arrangement of user control and display unit 6, which provides a permanent flow of ambient air around housing 6.2, the mounting blocks 12 of the present exemplary embodiment are designed in a manner that substantially avoids heat transfer between the upper part of front 2 and/or the body 11 and user control and display unit 6. To this end, mounting blocks 12 are made from a material having a low thermal conductivity. Alternatively, insulating layers having a low thermal conductivity could be provided between mounting blocks 12 and user control and display unit 6 and/or the upper part of front 2. Furthermore, it is also conceivable to provide the back of user control and display unit 6, which faces the upper part, with a coating that reflects thermal radiation. Moreover, other measures known to those skilled in the art and suitable for minimizing the heat transfer between the upper part of front 2 and user control and display unit 6 may also be used, alone or in combination with each other.

It is possible that when door 8 is closed, a cooling air inlet port or vapor exhaust port disposed 14 on the body 11 is covered by display and user control unit 6 in such a manner that the inlet or exhaust port cannot be visually perceived when looking in a direction perpendicular to outer surface 4 of front 2. In the embodiment shown in FIG. 5, a portion of control and display elements 6.1 of user control and display unit 6 is disposed on handle 10. In other embodiments, all of control and display elements 6.1 may be disposed on handle 10, or may form a unit with handle 10 as shown FIG. 4.

Alternatively or additionally, it is also conceivable that when door 8 is closed, the cooling air inlet port or vapor exhaust port is covered by display and user control unit 6 in such a manner that the air entering the inlet port and the air emerging from the exhaust port, respectively, is diverted by display and user control unit 6 into a predetermined direction.

Figure 3:
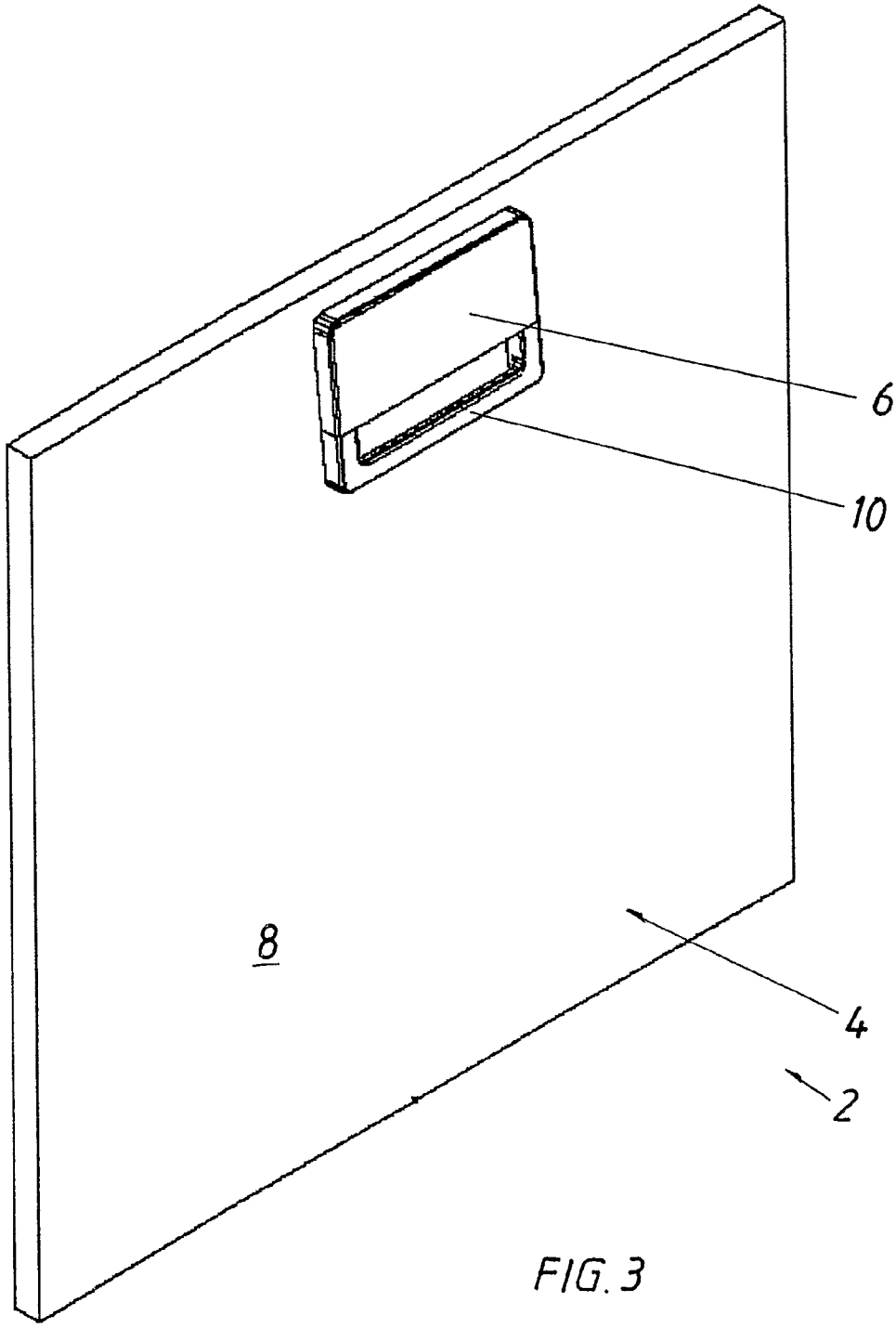
FIG. 3 is a partial perspective view of a second exemplary embodiment of a household appliance according to the present invention.
Figure 4:
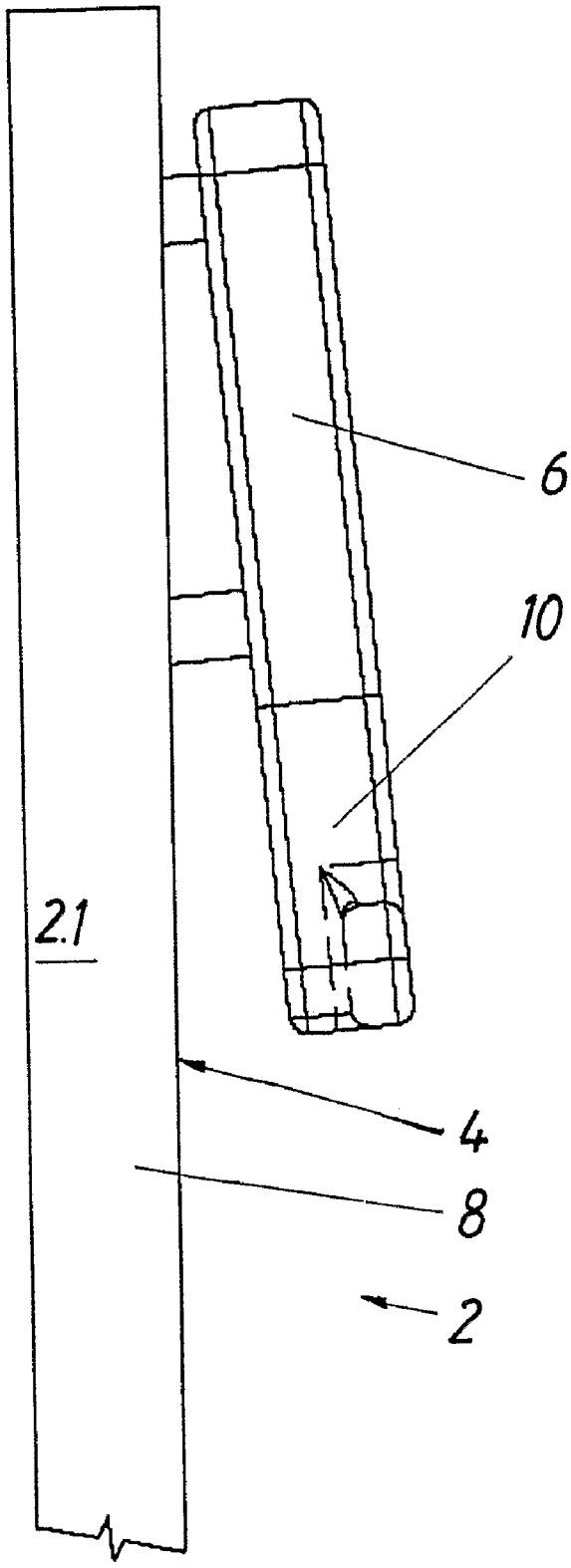
FIG. 4 is a partial side view of the second exemplary embodiment of FIG. 3.
Figure 5:
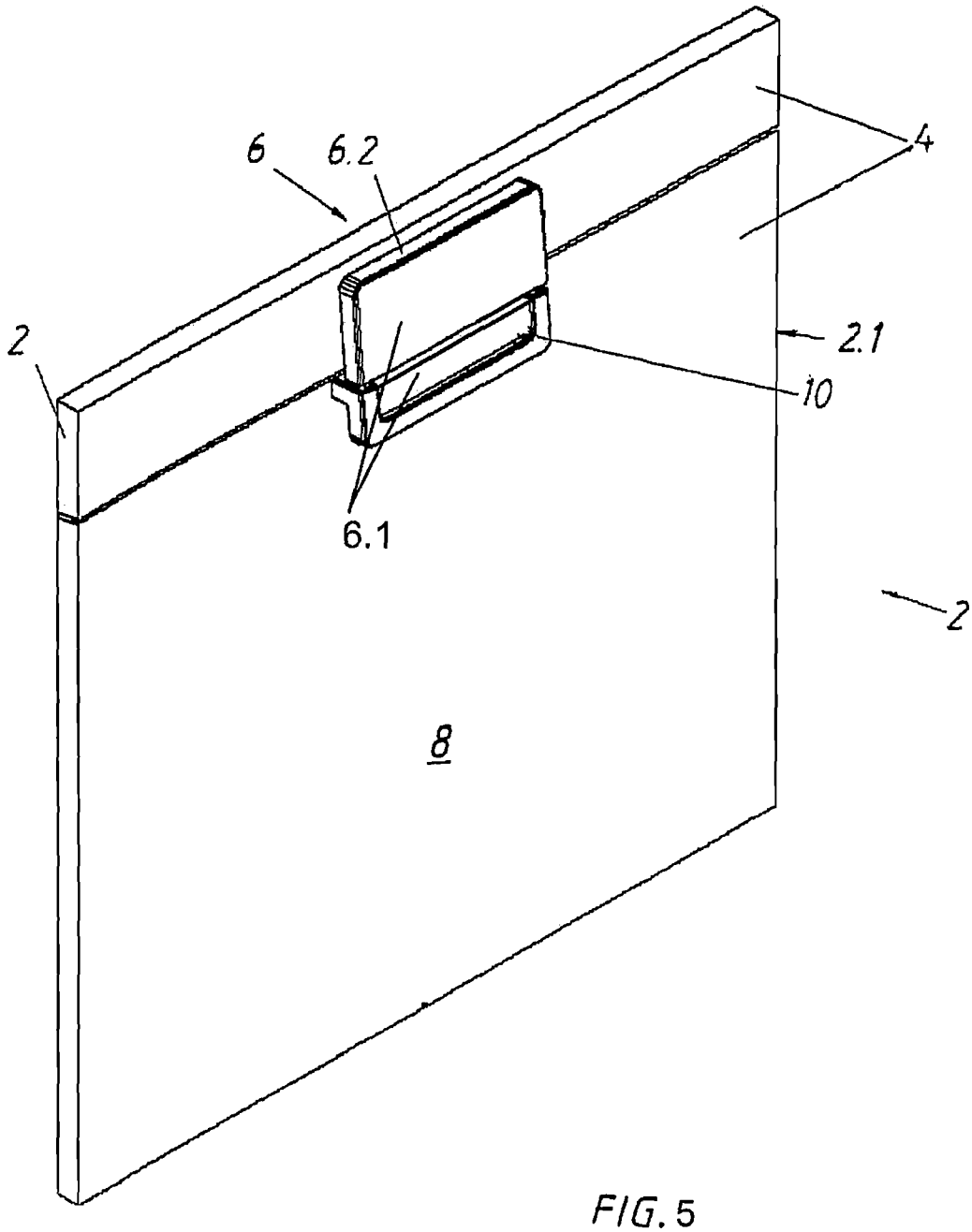
FIG. 5 is a partial perspective view of a third exemplary embodiment of a household appliance according to the present invention.

FIGS. 3 and 4 illustrate a second exemplary embodiment of a household appliance according to the present invention. Here, in contrast to the first exemplary embodiment, user control and display unit 6 is attached to door 8 of front 2, user control and display unit 6 forming a unit with handle 10.

What is claimed is:

1. A household appliance comprising:

a body having a front with a planar outer surface;

an appliance port including at least one of a cooling air inlet port and a vapor exhaust port disposed on the body;

a door configured to close an access opening of the appliance, the access opening being distinct from the appliance port; and a console-type user control and display unit, the user control and display unit including a control and display element, a housing, and control electronics disposed in the housing, the control electronics being configured for signal communication with the control and display element and with power electronics of the household appliance, at least a first portion of the user control and display unit being disposed on the door so as to be cooled by a flow of ambient air and so as to shield, when the door is in a closed position, the appliance port from view in a direction perpendicular to the planar outer surface of the front of the body.

2. The household appliance as recited in claim 1 further comprising a cooking unit.

3. The household appliance as recited in claim 1 wherein a second portion of the user control and display unit is disposed on an outer surface of the front.

4. The household appliance as recited in claim 3 wherein the second portion of the user control and display unit is disposed substantially equally spaced from lateral edges of the outer surface.

5. The household appliance as recited in claim 1 wherein the door includes a handle configured and disposed in an alignment with the user control and display unit so as to provide a visual impression of an extension of the user control and display unit when the door is closed.

6. The household appliance as recited in claim 1 wherein the at least a first portion of the user control and display unit is disposed substantially equally spaced from lateral edges of the door.

7. The household appliance as recited in claim 1 wherein the door includes a handle, and the at least a first portion of the user control and display unit is disposed on the handle.

8. The household appliance as recited in claim 1 wherein the door includes a handle configured to provide a visual impression of an extension of the user control and display unit.

9. The household appliance as recited in claim 1 wherein the user control and display unit includes a display unit having a control element.

10. The household appliance as recited in claim 1 wherein, when the door is in the closed position, the user control and display unit is disposed so as to divert, in a predetermined direction, air or gas entering or exiting the port.

11. The household appliance as recited in claim 1 wherein the at least a first portion of the user control and display unit is disposed so as to substantially avoid heat transfer from at least one of the body and the door.

* * * * *